US006361365B1

(12) United States Patent
Yu

(10) Patent No.: US 6,361,365 B1
(45) Date of Patent: Mar. 26, 2002

(54) ELECTRICAL CONNECTOR HAVING CONNECTED GROUNDING PLATE AND GROUNDING PINS

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/854,008

(22) Filed: May 10, 2001

(30) Foreign Application Priority Data

Dec. 26, 2000 (TW) ..... 089222493

(51) Int. Cl.[7] ..... H01R 13/648

(52) U.S. Cl. ..... 439/607; 439/95

(58) Field of Search ..... 439/607, 609, 439/95, 101

(56) References Cited

U.S. PATENT DOCUMENTS 5,470,259 A * 11/1995 Kaufman et al. ..... 439/607

* cited by examiner

*Primary Examiner*—Brian Sircus
*Assistant Examiner*—Javaid Nasri
(74) *Attorney, Agent, or Firm*—Wei Te Chung

(57) ABSTRACT

An electrical connector includes an insulative housing (2), a plurality of signal and grounding terminals (4, 5) received in the housing, and a grounding plate (3). The housing comprises a main body (200) which defines a plurality of through holes (206) and the grounding terminals are received and secured therein. The grounding plate comprises a main portion (31) covering the main body, a pair of beams (30) extending from a pair of ends of the main portion and being soldered on a printed circuit board (7). A pair of grounding pins (34) is integrally formed on each beam. Each grounding pin is partly received and secured in the corresponding through hole to receive and contact the grounding terminal to form an electrical connection between the grounding terminal and the grounding pin.

1 Claim, 5 Drawing Sheets

ELECTRICAL CONNECTOR HAVING CONNECTED GROUNDING PLATE AND GROUNDING PINS

BACKGROUND OF THE INVENTION

1. Field of the Invention

The present invention relates to an electrical connector, and particularly to an electrical connector having a grounding plate and grounding pins connected together to achieve a good grounding effect.

2. Description of Related Art

U.S. Pat. No. 5,470,259 discloses an electrical connector 22 having a ground shroud 50 and a plurality of conductive signal and grounding terminals 36 secured in a housing 24 of the connector 22. The ground shroud 50 comprises a first portion 54 and a second portion 62 which has a plurality of second contact sections 70 extending outwardly therefrom for being soldered in through holes 86 of the circuit board 80. The grounding terminals 36 are soldered with contact pads 84 on the circuit board 80. To this design, the circuit board 80 must provide much room to arrange through holes 86 and contact pads 84 for connecting the second contact sections 70 and grounding terminals 36. A limited room on the printed circuit bard is valuable, and decreasing occupying room of the electrical connector on the printed circuit board is desirable. In addition, manufacturing the through holes 86 and designing the contact pads 84 on the printed circuit board 80 is burdensome. Furthermore, total number of the through holes 86 and contact pads 84 is too large, if one electrical connection between the second contact section 70 and grounding circuitry of the through hole 86 or one electrical connection between the grounding terminal 36 and the contact pad 84 is not reliable, grounding effect will be influenced. Hence, an improved electrical connector having a good grounding effect and occupying less room on the printed circuit board is desirable.

SUMMARY OF THE INVENTION

Accordingly, the object of the present invention is to provide an electrical connector having a good grounding effect.

In order to achieve the object set forth, an electrical connector comprises an insulative housing, a plurality of signal and grounding terminals received in the housing, and a grounding plate covered on the housing to shield the terminals. The housing comprises a main body which defines a plurality of through holes extending therethrough, and the grounding terminals are secured in the through holes. The grounding plate comprises a main portion covered on the main body of the housing, a pair of beams extending from a pair of ends of the main portion and being bent to be soldered on a printed circuit board. A pair of grounding pins is integrality formed on each beam. Each grounding pin is partly secured in the corresponding through hole to receive and contact the grounding terminal to form an electrical connection between the grounding terminal and the grounding pin. Thus, an electrical trace from the grounding plate and grounding terminal to the ground circuitry of the printed circuit board is established.

Other objects, advantages and novel features of the invention will become more apparent from the following detailed description when taken in conjunction with the accompanying drawings.

DETAILED DESCRIPTION OF THE INVENTION

Figure 1:
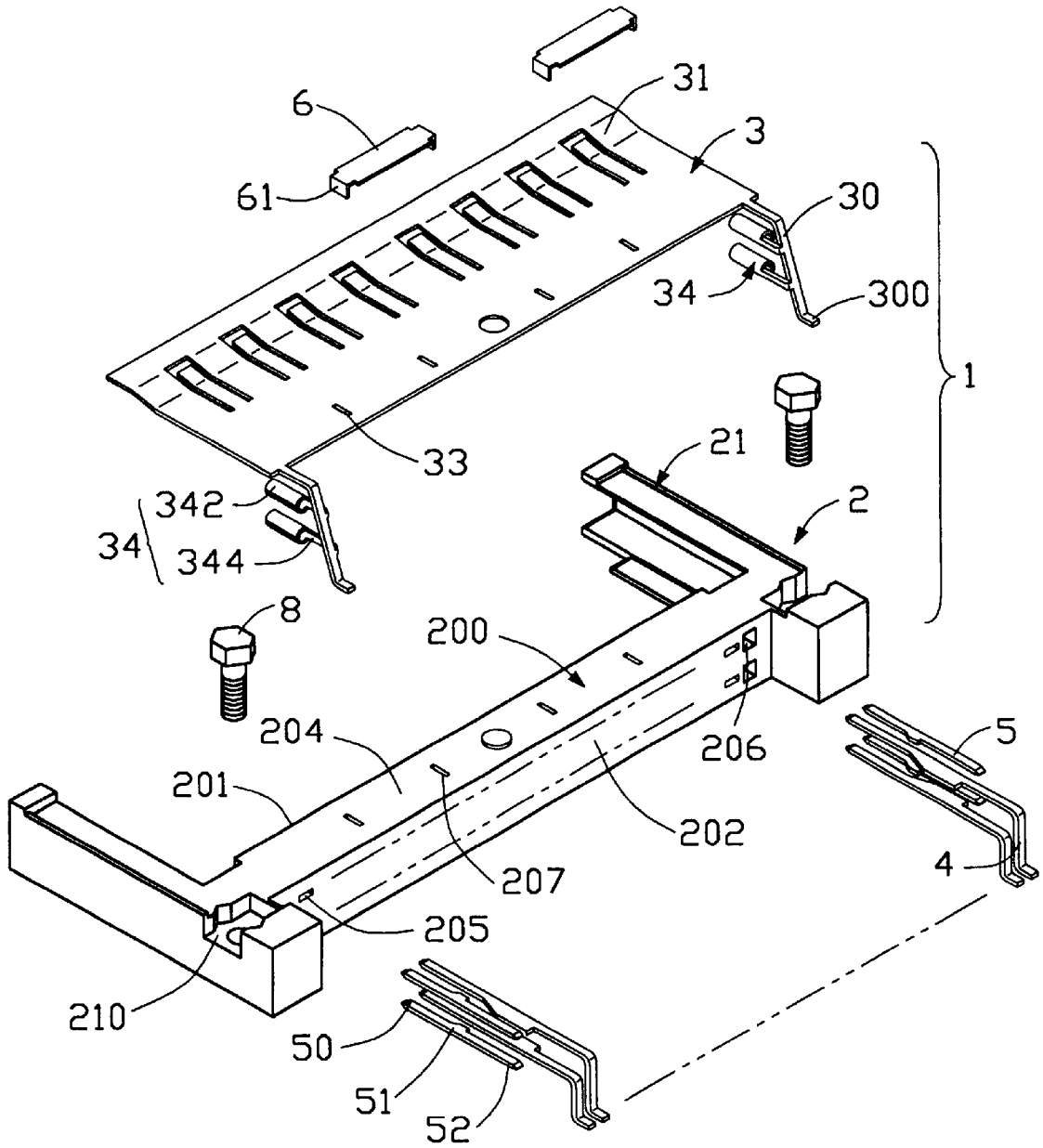
FIG. 1 is an exploded view of an electrical connector of the present invention.

For facilitating understanding, like components are designated by like reference numerals throughout the various embodiments of the invention as shown in the various drawing figures.

Referring to FIG. 1, an electrical connector 1 of the present invention comprises an insulative housing 2, a plurality of signal terminals 4, a plurality of grounding terminals 5, and a grounding plate 3.

The housing 2 comprises a main body 200 and a pair of arms 21 located at a pair of ends of the main body 200. The main body 200 comprises a mating face 201, a mounting face 202 opposite the mating face 201, and an upper face 204 adjacent to the mating face 201 and the mounting face 202. A plurality of receiving holes 205 defined in the main body 200 extends through the mating face 201 and the mounting face 202. Two pairs of through holes 206 are respectively defined at a pair of ends of the main body 200 extending through the mating face 201 and the mounting face 202. All the receiving holes 205 are located between the two pairs of through holes 206. Each through hole 206 comprises a passageway 2062 defined from the mating face 201 and a recess 2064 defined from the mounting face 202 communicating with the passageway 2062. The upper face 204 of the main body 200 defines two pairs of recesses 207. Each arm 21 defines an engaging hole 210 adjacent to the main body 200.

Each grounding terminal 5 has a mating portion 50, a contacting portion 52, and an engaging portion 51 between the mating portion 50 and the contacting portion 52.

Figure 2:
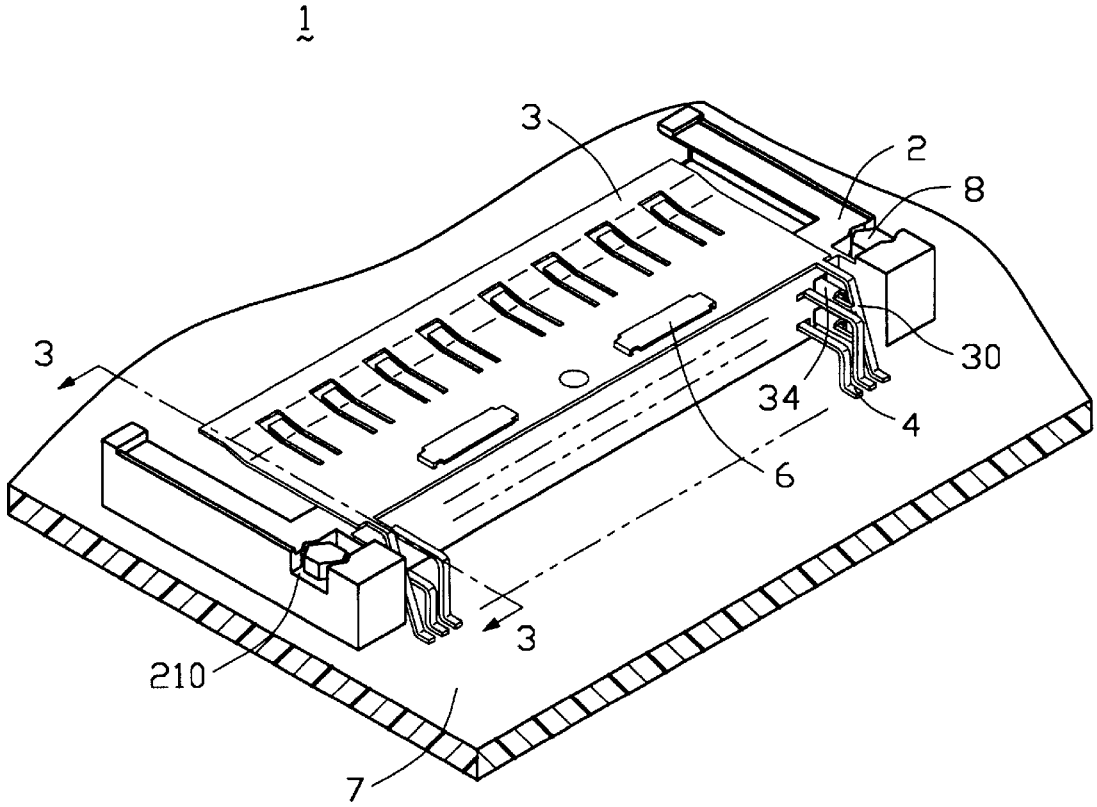
FIG. 2 is an assembled view of FIG. 1.

A grounding plate 3 comprises a main portion 31, and a pair of beams 30 extending from the main portion 31. The main portion 31 defines two pairs of slots 33 corresponding to the recesses 207 of the housing 2. The beam 30 is bent to form a solder portion 300 at a free end thereof for being soldered on a printed circuit board 7 (as shown in FIG. 2). A pair of curly grounding pins 34 extending from the beams 30.

Figure 4:
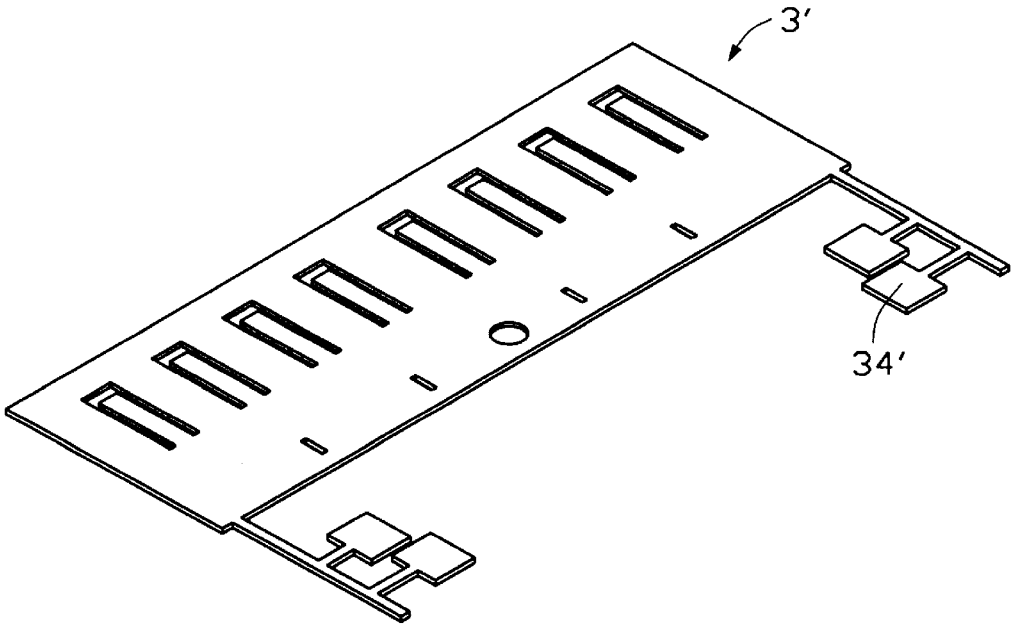
FIG. 4 is a perspective view of a grounding plate in semi-finished state.
Figure 5:
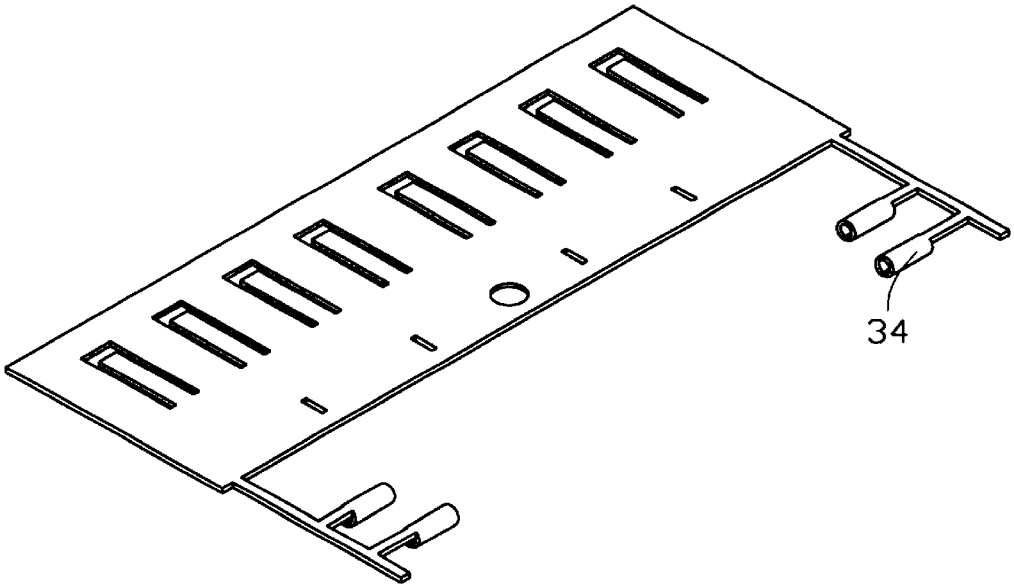
FIG. 5 is a perspective view of the semi-finished grounding plate with grounding pins being rolled.
Figure 6:
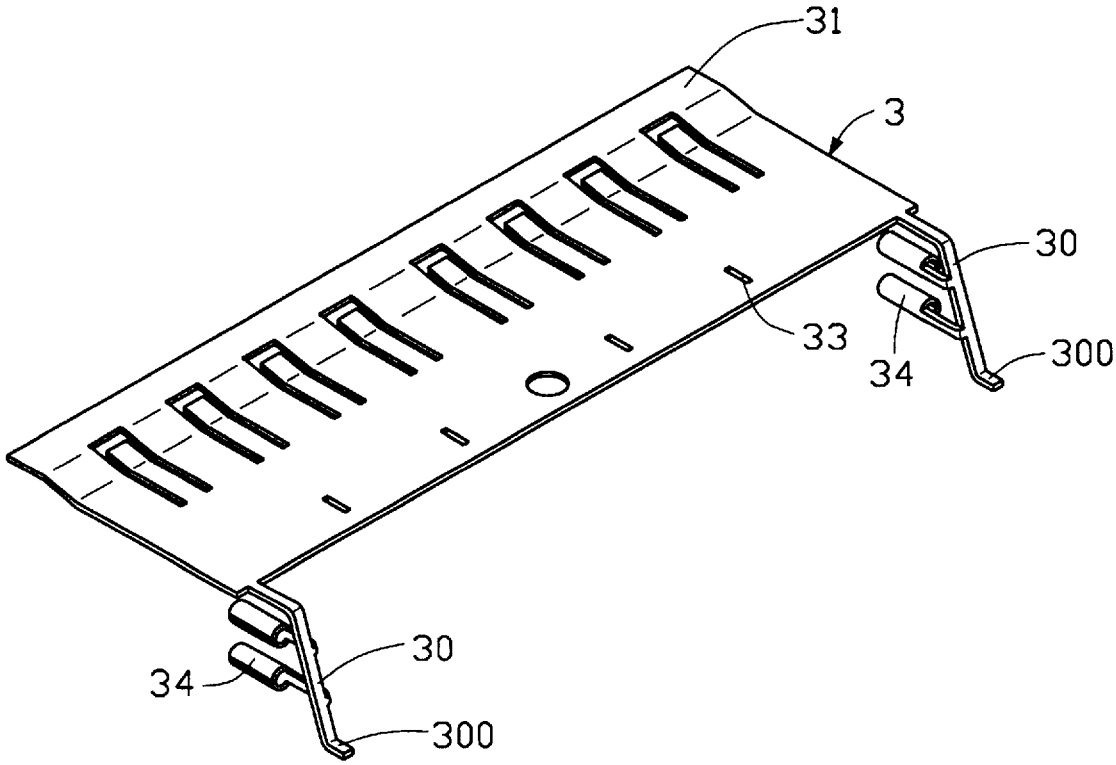
FIG. 6 is a perspective view of the fully finished grounding plate.

Referring to FIGS. 4–6, a semi-finished grounding plate 3' is stamped from a metal material to form a first and a second pairs of plain plates 34' extending from the beams 30. The first pair of plain plates 34' is adjacent to the main portion 31 and the second pair of plain plates 34' is adjacent to the solder portions 300 of the beams 30. Each plain plate 34' is rolled to form the curly grounding pin 34. The grounding pin 34 comprises a column portion 342 and a connection portion 344 connecting the column portion 342 to the beam 30. A receiving space 301 is defined in the column portion 342 of the grounding pin 34.

Figure 3:
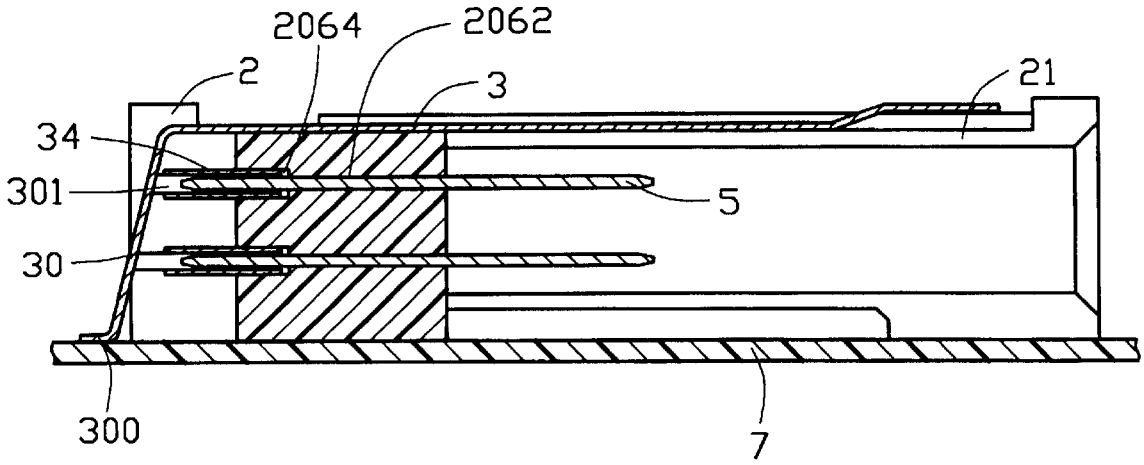
FIG. 3 is a cross sectional view of FIG. 2 taken along line 3—3.

Referring to FIGS. 2–3, in assembly, the signal terminals 4 are assembled in the receiving holes 205 of the main body 200. The grounding terminals 5 are inserted into the through holes 206 so that each engaging portion 51 engages with a side wall of the passageway 2062 of the through hole 206, the mating portion 50 extends beyond the mating face 201, and the contacting portion 52 remains in the recess 2064 of the through hole 206. The grounding plate 3 is covered on the main body 200 with the slots 33 aligning with the corresponding recesses 207, the grounding pins 34 securely inserted into the recesses 2064 of the through holes 206 and each contacting portion 52 of the grounding terminal 5 received in the receiving space 301 and contacting with an inner wall of the grounding pin 34. The electrical connector further comprises a pair of positioning members 6. Each positioning member 6 forms a pair of securing portions 61. The positioning members 6 can secure the grounding plate 3 to the main body 200 with the securing portions 61 inserted into and secured in the recesses 207 of the main body 200.

The electrical connector further comprises a pair of screw elements 8 inserted into the engaging holes 210 thereby securing the housing 2 to the printed circuit board 7. The signal terminals 4 are soldered on the printed circuit board 7. The solder portions 300 of the beams 30 are soldered to the printed circuit board 7 thereby establishing a grounding circuitry from the main portion 31 and the grounding pins 34 to grounding trace of the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a housing having a main body which has a mating face, an opposite mounting face, and a plurality of through holes extending from the mating face through the mounting face;

a plurality of signal terminals received in the main body and a plurality of grounding terminals received and secured in the through holes of the main body; and a grounding plate having a main portion covering the main body, a pair of beams integrally extending from a pair of ends of the main portion and adapted to be soldered to a grounding circuitry of a printed circuit board, and a plurality of grounding pins integrally extending from the beams, the grounding pins electrically contacting with the grounding terminals; wherein each beam has a solder portion at a free end thereof adapted to be soldered to the grounding circuitry of the printed circuit board; wherein each through hole comprises a passageway defined from the mating face of the housing, and a recess defined from the mounting face of the housing and communicating with the passageway; wherein the plurality of grounding pins comprises two pairs of grounding pins extending from the beams, and the plurality of grounding pins comprise a first pair of grounding pins adjacent to the main portion and a second pair of grounding pins adjacent to the solder portions of the beams; wherein each grounding pin comprises a column portion and a connection portion connecting the column portion to the beam; wherein the column portion of the grounding pin defines a receiving space therein; wherein each grounding pin is inserted and secured into the recess of the through hole; wherein each of the grounding terminals comprises a mating portion extending beyond the mating face, a contacting portion inserted into the receiving space of the grounding pin and contacting an inner wall of the grounding pin, and an engaging portion between the mating portion and the contacting portion and engaged with an inner wall of the passageway of the through hole of the main body.

* * * * *